US005255599A

United States Patent [19]

Kobayasi et al.

[11] Patent Number: 5,255,599

[45] Date of Patent: Oct. 26, 1993

[54] STENCIL AND SCREEN ASSEMBLY FOR A PRINTER

[75] Inventors: Kazuyosi Kobayasi, Murata; Tomoya Otomo, Sendai; Mitsuo Saté, Shibata, all of Japan

[73] Assignee: Ricoh Company, Ltd., Tokyo, Japan

[21] Appl. No.: 952,803

[22] Filed: Sep. 28, 1992

Related U.S. Application Data

[62] Division of Ser. No. 753,235, Aug. 30, 1991, Pat. No. 5,172,632.

[30] Foreign Application Priority Data

| | | | |
|---|---|---|---|
| Aug. 31, 1990 | [JP] | Japan | 2-232074 |
| Dec. 7, 1990 | [JP] | Japan | 2-407377 |
| Dec. 11, 1990 | [JP] | Japan | 2-402870 |
| Feb. 18, 1991 | [JP] | Japan | 3-13684 |
| Mar. 25, 1991 | [JP] | Japan | 3-60116 |

[51] Int. Cl.[5] ..... B41L 13/10

[52] U.S. Cl. ..... 101/119; 101/116

[58] Field of Search ..... 101/116–120, 101/123, 124, 127.1, 128.1; 118/406, 409

[56] References Cited

U.S. PATENT DOCUMENTS

| | | | |
|---|---|---|---|
| 2,704,025 | 3/1955 | Anderson et al. | 101/128.1 |
| 3,031,956 | 5/1962 | Worth | 101/119 |
| 3,312,165 | 4/1967 | Strom | 101/19 |

FOREIGN PATENT DOCUMENTS

| | | | |
|---|---|---|---|
| 54-174407 | 12/1979 | Japan . | |
| 51482 | 3/1982 | Japan | 101/120 |
| 89987 | 6/1982 | Japan | 101/119 |
| 59-54039 | 12/1984 | Japan . | |
| 60-28670 | 7/1985 | Japan . | |
| 165295 | 8/1985 | Japan | 101/120 |
| 61-31830 | 2/1986 | Japan . | |

*Primary Examiner*—Edgar S. Burr
*Assistant Examiner*—Stephen R. Funk
*Attorney, Agent, or Firm*—Oblon, Spivak, McClelland, Maier & Neustadt

[57] ABSTRACT

A printer for printing out an image formed in a stencil on a sheet. The stencil formed with perforations representative of an image is wrapped around a drum which is made up of a hollow cylindrical support and a mesh screen covering the support. The cylindrical support has an apertured portion and a non-apertured portion and accommodates an inking roller therein for supplying ink to a sheet via the stencil. The sheet is pressed against the stencil by a press roller that faces the inking roller with the intermediary of the drum. A high friction member is located at a predetermined position on the non-apertured portion of the drum or a predetermined position on the mesh screen corresponding to a position where the press roller begins to press a sheet against the stencil.

3 Claims, 10 Drawing Sheets

FIG. 5A
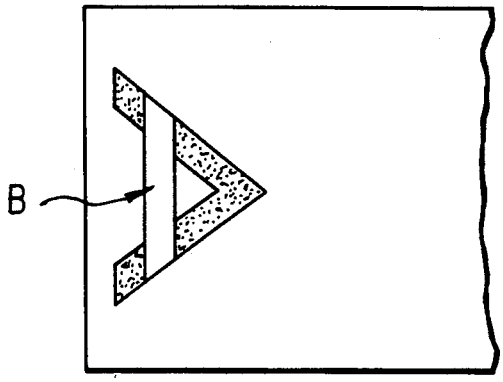
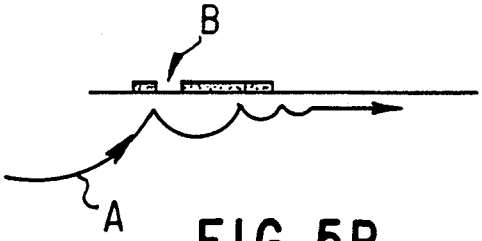
FIG. 5B

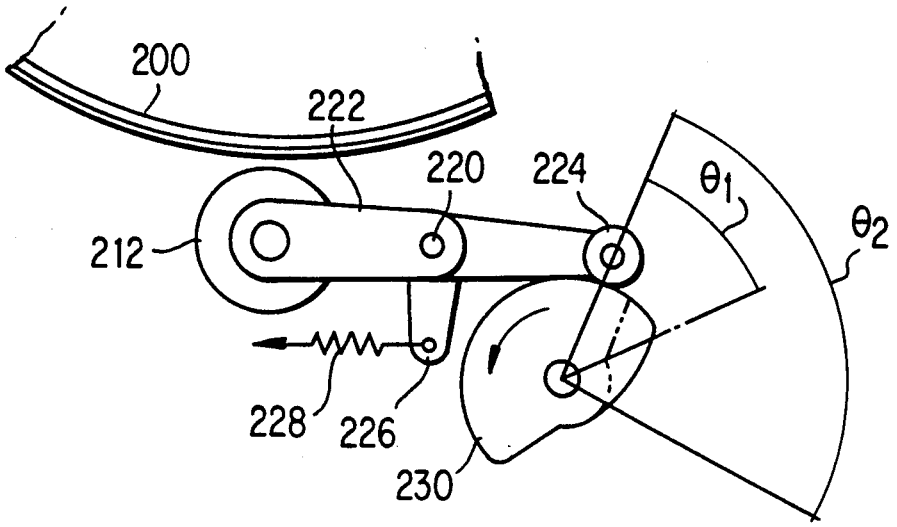
FIG. 8
FIG. 9A
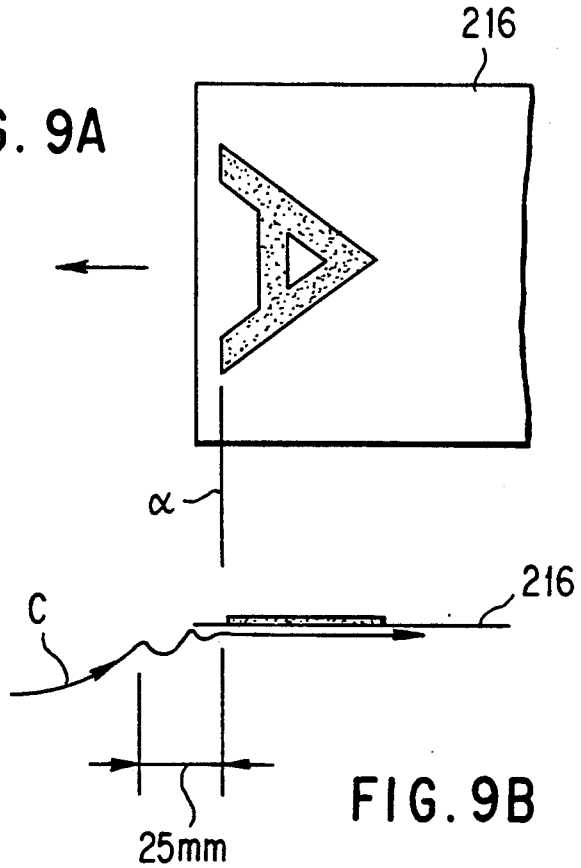
FIG. 9B

STENCIL AND SCREEN ASSEMBLY FOR A PRINTER

This is a division, of application Ser. No. 07/753,235, filed on Aug. 30, 1991 now U.S. Pat. No. 5,172,632.

BACKGROUND OF THE INVENTION

The present invention relates to a printer for printing out an image on a sheet by wrapping a stencil formed with perforations representative of the image around an apertured drum, and supplying ink to a sheet via the drum and stencil while pressing the sheet against the stencil by a press roller.

In a printer of the type described, a clamper is provided on a drum for retaining one edge of a stencil wrapped around the drum. As the drum is rotated, the stencil is rotated together with the drum while being pulled by the clamper. It is likely that the stencil so retained on the drum is pulled in the opposite direction to the direction of rotation of the drum due to various factors. Specifically the impact which a press roller exerts on contacting the drum via the stencil and a sheet is one factor. Another factor is the loads ascribable to the rotation of the press roller and an inking roller which is disposed in the drum. Still another factor is the load exerted by a sheet feed device while the stencil is transported by the drum together with a sheet by being held between the drum and the press roller. As a result, when a number of printings are produced with the single stencil wrapped around the drum, the edge of the stencil retained by the clamper is apt to slip out of the clamper little by little. Then, the stencil is dislocated on the drum to have the print start position thereof changed, preventing an image from being accurately printed out in a predetermined position on a sheet.

Various attempts have been made to prevent the stencil wrapped around the drum from being released from the clamper. For example, the clamper may be implemented by a metallic plate and a rubber plate having a magnet. As the force of the magnet provided on the rubber plate is increased, the clamper retains the stencil more positively on the drum. However, the problem with this approach is that the overall size of the clamper is increased and, in addition, a great force is necessary for the metallic plate and rubber plate to be moved toward and away from each other. One of the two members for clamping the edge of the stencil may be constituted by a high friction member, as disclosed in Japanese Utility Model Laid-Open Publication No. 31830/1986. This kind of scheme, however, is apt to damage the stencil since it forcibly prevents the stencil from slipping out of the clamper by the high friction member, i.e., it exerts a substantial load on the stencil. Moreover, the high friction member is apt to catch a sheet, bringing about a jam problem.

Japanese Utility Mode Laid-Open Publication No. 174407/1979, for example, teaches a press roller which is rotatably supported by one end of a rotatable arm and pressed against the drum by a spring or similar resilient member. The time when the press roller begins to press itself against the drum and the time when the former leaves the latter are determined by the profile of a cam with which a cam follower is engaged. The cam follower is mounted on a support member which supports the press roller. Usually, the cam is configured such that the press roller begins to contact the drum, i.e., the stencil at a particular time associated with a position slightly ahead of the leading edge of the perforated portion of the stencil, i.e., a perforation start point. However, the problem is that the press roller oscillates due to bounce when it hits against the rigid drum under the action of the spring. Such a bounce or oscillation will effect an image little so long as the drum is rotated at low speed, since the rotation or displacment of the drum up to the time when the bounce or the oscillation terminates is small. Nevertheless, the above-mentioned displacement of the drum increases with the increase in the rotation speed of the drum. During this period of time, the pressure exerted by the inking roller on the inner periphery of the drum and the pressure exerted by the press roller on the stencil and sheet are not sufficient, obstructing a stable operation. Specifically, ink fails to reach some portions of a sheet associated with the locus of the bounce or oscillation of the press roller. Then, an image is locally lost in such portions of the sheet while the resulted image density distribution is irregular. Moreover, when the press roller is to abut against the drum which is rotating at high speed, the cam is also rotated at high speed. Therefore, if the cam has a profile which causes the press roller into contact with the drum instantaneously, the press roller produces noise on hitting against the drum in the portion of the cam where the profile sharply changes.

The drum is made up of an apertured hollow cylindrical support and a mesh screen covering the outer periphery of the support. The outer periphery of the cylindrical support has a permeable zone for passing ink from the inking roller therethrough to the stencil via the mesh screen, and a non-permeable zone. The mesh screen is affixed at the leading edge thereof to the support by screws or similar fastening means. The trailing edge of the mesh screen is constantly pulled by, for example, a spring. As the printing operation is continued with a stencil wrapped around such a drum to produce a great number of printings, the ink intervening between the stencil and the support of the drum, i.e., impregnated into the mesh screen is sequentially forced to the rear by the press roller until it bulges out from between the trailing edge of the stencil and that of the screen. This part of the ink smears not only the outer periphery of the drum but also the trailing edge of the sheet and the press roller. The press roller so smeared would in turn smear the back of the sheet. At the same time, the ink sequentially forced to the rear by the press roller also enters the interstice between the support and the trailing edge of the screen to bulge out from the trailing edge of the screen. This smears the outer periphery of the support and, therefore, the sheet. This problem is especially pronounced when use is made of soft and highly infiltrative ink.

An approach to prevent ink from bulging out from between the trailing edges of the stencil and mesh screen is proposed in, for example, Japanese Patent Publication No. 28670/1985. This approach, however, cannot prevent the ink having entered the interstice between the support and the trailing edge of the screen from bulging out and depositing on the outer periphery of the support. Although the trailing edge of the screen may be adhered to the outer periphery of the support to eliminate such an occurrence, adhesion is not desirable since the trailing edge of the screen is constantly pulled to the rear by a spring or similar biasing means, as stated above.

On the other hand, the ink from the inking roller disposed in the drum is supplied to the stencil via the apertures formed in the permeable zone of the support. Part of this ink sometimes leaks to the outside at opposite sides of the drum to smear various parts and elements built in the printer. Japanese Patent Publication No. 54039/1984 discloses a countermeasure to this kind of contamination. Specifically, a scraper is provided on the inner periphery of the drum and inclined relative to the direction of rotation of the drum so as to collect the ink bulging out at the position where the inking roller and the drum contact each other. More specifically, as the ink existing between the inking roller and the drum is forced out from the end of the inking roller when the press roller presses itself against the drum, the scraper guides such ink inwardly in the axial direction of the inking roller. However, the flow of ink is not stable when the ambient temperature is low and the printing operation is affected at high speed. It follows that the ink deposits on the scraper and is scattered around in masses in the event of printing. As a result, the scraper fails to serve the expected function and causes irregularities to occur in a printed image.

SUMMARY OF THE INVENTION

It is, therefore, a first object of the present invention to provide a printer capable of preventing a stencil wrapped around a drum from slipping out of a clamper.

It is a second object of the present invention to provide a printer capable of freeing a printed image from degradation ascribable to the bounce or oscillation of a press roller which occurs when the roller presses itself against a drum, and eliminating noise also ascribable to the press roller.

It is a third object of the present invention to provide a printer capable of preventing ink intervening between a hollow cylindrical support of a drum and a stencil from leaking from between the rear edge of a mesh screen and that of the stencil and from between the trailing edge of the screen and the support.

A fourth object of the present invention is to provide a printer capable of preventing ink supplied from an inking roller from leaking to the outside at opposite sides of a drum.

A printer for printing out an image formed in a stencil on a sheet of the present invention includes a rotatable drum having a hollow cylindrical support which is made up of an apertured portion formed with a number of apertures and a non-apertured portion. A stencil is wrapped around the outer periphery of the support. A clamper is provided on the non-apertured portion of the support for clamping one edge of the stencil wrapped around the support. An inking roller is disposed in the support for supplying ink to the stencil via the apertured portion of the support. A press roller presses a sheet against the stencil. A high friction member is provided on the outer periphery of the drum for preventing the stencil wrapped around the drum from slipping out of the clamper.

BRIEF DESCRIPTION OF THE DRAWINGS

The above and other objects, features and advantages of the present invention will become more apparent from the following detailed description taken with the accompanying drawings in which:

FIGS. 5A and 5B are views for explaining a problem particular to a conventional printer of the type to which the present invention pertains;

FIG. 8 is a fragmentary view showing a specific construction of a press roller drive mechanism included in the second embodiment;

FIGS. 9A and 9B are views representative of the operation of a press roller included in the second embodiment;

DESCRIPTION OF THE PREFERRED EMBODIMENTS

Preferred embodiments of the printer using a stencil in accordance with the present invention will be described hereinafter.

FIRST EMBODIMENT

This embodiment is directed toward the previously stated first object of the present invention, i.e., preventing the leading edge of a stencil from slipping out of a clamper.

Figure 1:
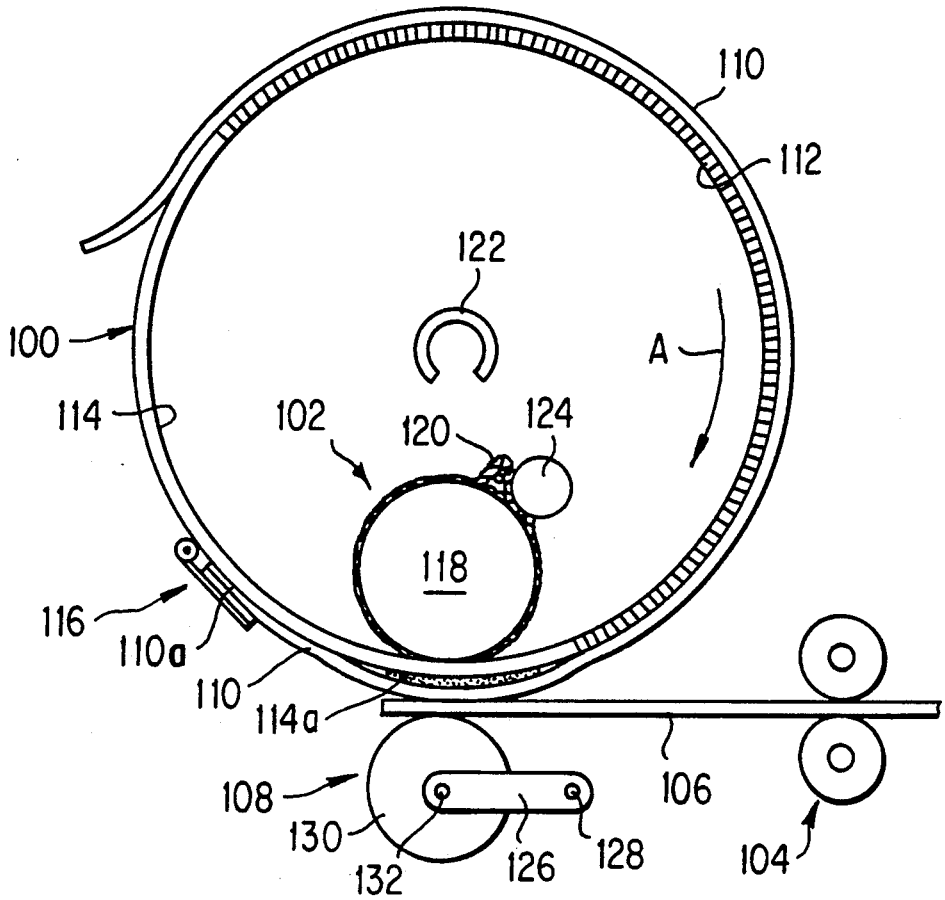
FIGS. 1 and 2 are views showing the construction and operation of a first embodiment of the printer in accordance with the present invention.

As shown in FIG. 1, the printer has a drum implemented as a hollow cylindrical support and rotatable in a direction indicated by an arrow A. An ink supply device 102 is disposed in the drum 100. A register roller pair 104 drives a recording medium in the form of a sheet 106 toward the drum 100 at a predetermined timing. A pressing device 108 presses the sheet 106 against the drum 100. A stencil 110 having perforations representative of an image is wrapped around the drum 100. The drum 100 is made up of an apertured portion 112 and a non-apertured portion 114. The apertured portion 112 has a number of apertures for supplying ink from the ink supply device 102 to the image area of the stencil 110. A clamper 116 is provided on the non-apertured portion 114 of the drum 100 in order to retain the leading edge 110*a* of the stencil 110. The ink supply device 102 has an inking roller 118 contacting the inner periphery of the drum 100, an ink supply tube 122 for supplying ink to the inking roller 118, and a doctor roller 124 contacting the inking roller 118 to regulate the amount of ink supplied to the roller 118. The pressing device 108 has an arm 126 rotatably mounted on a shaft 128 at one end thereof, and a press roller 130 rotatably mounted on a shaft 132 which is supported by the other end of the arm 126. The press roller 130 presses the sheet 106 against the drum 100, i.e., the stencil 110 in a predetermined print position where the roller 130 faces the roller 118. The clamper 116 may be implemented by a metallic plate and a rubber plate with a magnet which are conventional.

In operation, the clamper 116 clamps the leading edge 110*a* of the stencil 110 having been cut by, for example, a thermal head. The drum 100 is rotated in the direction A to cause the stencil 110 to wrap therearound. At this stage of operation, the press roller 130 of the pressing device 108 is held in a standby position spaced apart from the drum 100. In response to a print command, sheets 106 are sequentially fed one by one from a sheet feed section, not shown. The sheet 106 is driven by the register roller pair 104 to the print position just below the inking roller 118 at such a timing that it meets the image of the stencil 110 having been retained on the drum 100. When a sheet sensing device, not shown, senses the sheet 106, the press roller 130 is raised away from the standby position to press the sheet 106 against the stencil 110, as shown in FIG. 1. As the drum 100 rotates in the direction A, the stencil 110 and sheet 106 move together via the print position while being pressed against each other by the press roller 130. At the print position, ink 120 deposited on the inking roller 118 oozes out onto the sheet 106 via the apertures of the apertured portion 112 of the drum 100 and the perforations of the stencil 110, whereby the image is transferred from the stencil 110 to the sheet 106. When the non-apertured portion 114 of the drum 100 is about to reach the print position, the press roller 130 is moved away from the drum 100 and thereby prevented from interfering with the clamper 116. In this position, the press roller 130 awaits the arrival of the next sheet 106. Such a procedure is repeated with each of the sheets 106 which are sequentially fed to the print position.

At the instant when the press roller 130 begins to contact the drum 100, as illustrated in FIG. 1, the pressing force of the roller 130 and, therefore, the friction acting between the stencil 110 and the drum 100 is not sufficient. In this condition, it is likely that the stencil 110 is dislocated on the drum 100. Moreover, as the movement of the press roller 130 toward and away from the drum 100 is repeated during printing operation, the dislocation of the stencil 110 is sequentially increased. In the worst case, the leading edge 110*a* of the stencil 110 slips out of the clamper 116.

Figure 2:
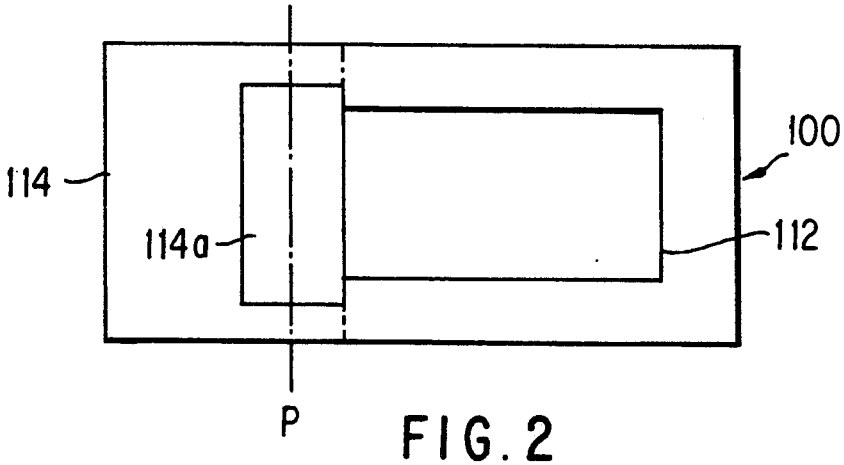

In light of the above, as shown in FIGS. 1 and 2, a high friction member 114*a* is provided on the non-apertured portion 114 of the drum 100 in a position corresponding to a position P where the press roller 130 begins to contact the drum 100, i.e., the stencil 110 and sheet 106. The high friction member 114*a* insures a great friction between the stencil 110 and the drum 100 when the press roller 130 is brought into contact with the drum 100, thereby reducing the dislocation of the stencil 110 as far as possible. In the apertured portion 112 of the drum 100 which joins in the printing operation, a sufficient friction acts between the stencil 110 and the drum 100 due to the viscocity of the ink 120 and protects the stencil 110 against dislocation even if some unexpected load is exerted on the sheet 106 by the sheet feed section. The high friction member 114*a* may be implemented by sand paper #120 to #320. A better result is achievable when the press roller 130 is made of a softer material. To determine the dislocation of the stencil 110, the stencil 110 was used to produce 2,000 printings continuously at a rate of 120 printings per minute. The dislocation was measured to be only 0 millimeter to 0.5 millimeter with the embodiment and as great as 5 millimeters to 12 millimeters with a drum without the high friction member 114*a*.

Figure 3:
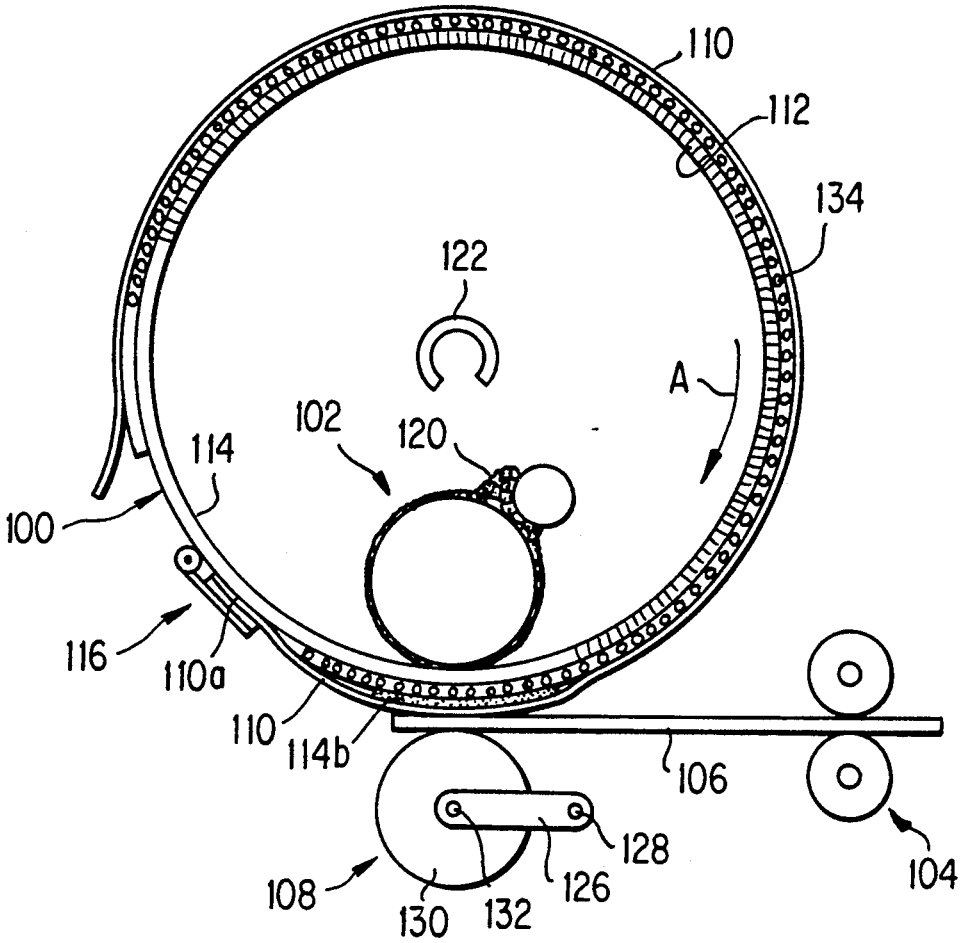
FIGS. 3 and 4 are views showing a modified form of the first embodiment.
Figure 4:
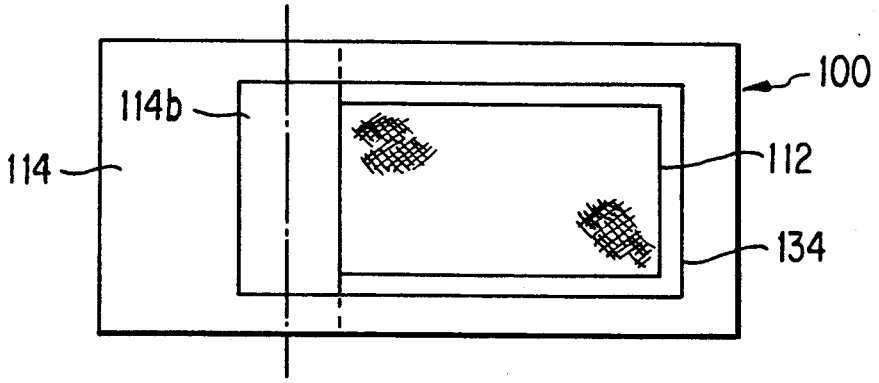
Figure 6:
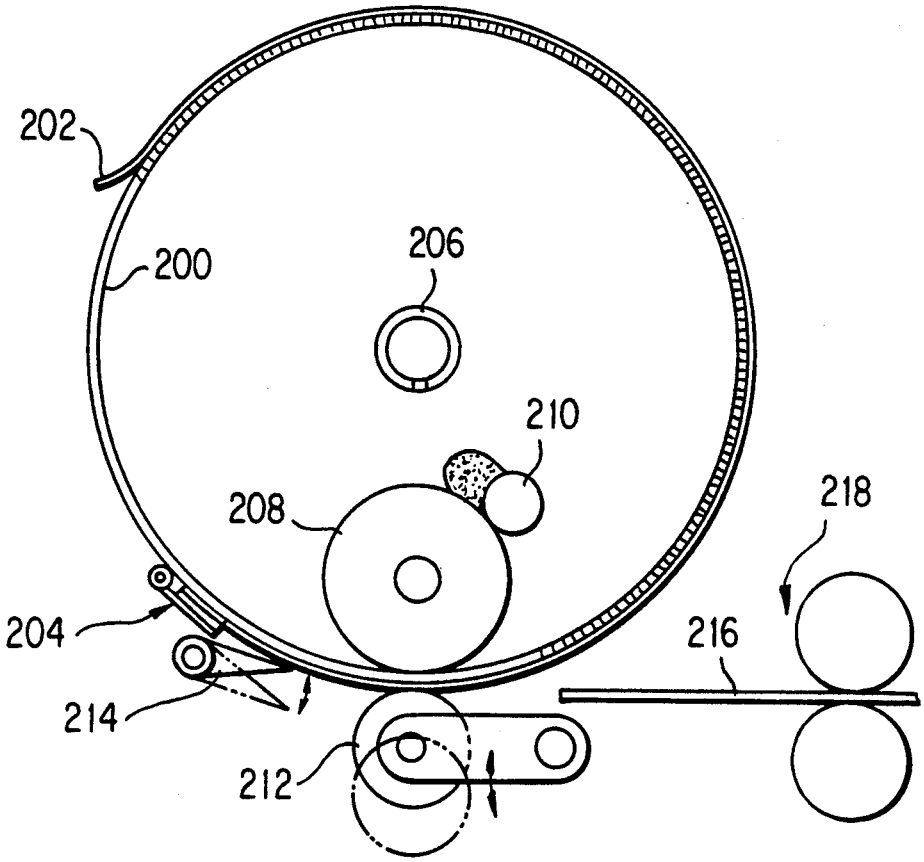
FIGS. 6 and 7 are views showing the construction and operation of a second embodiment of the present invention.

The illustrative embodiment is similarly applicable to a drum of the type having a mesh screen on a hollow cylindrical support. Specifically, as shown in FIGS. 3 and 4, a mesh screen 134 is provided on the entire outer periphery of the hollow cylindrical support or drum 100. A high friction member 114*b* is provided on the mesh screen 134 in a position corresponding to the position P where the press roller 130 begins to contact the drum 100. The high friction member 114*b* is as effective as the previously mentioned high friction member 114*a* in reducing the dislocation of the stencil 110.

As stated above, this embodiment has a high friction member provided on part of the non-apertured portion of a drum or part of a mesh screen which corresponds to a position where a press roller begins to contact the drum. Hence, a great friction acts between the drum and a stencil wrapped therearound to substantially free the stencil from dislocation.

Second Embodiment

This embodiment is directed toward the previously stated second object, i.e., eliminating the degradation of printings due to the bounce and oscillation of the press roller as well as noise.

The press roller of a pressing device is urged against a rigid drum by a spring and, therefore, apt to spring back or oscillate when brought into contact with the drum. The resultant locus of the press roller relative to a sheet is indicated by A in FIG. 5. As a result, ink fails to deposit on some portions of the sheet, i.e., the image is partly lost on the sheet as at B and, moreover, the density distribution of the printing becomes irregular. This embodiment is successful in eliminating such an occurrence.

As shown in FIGS. 6 through 9, the alternative embodiment has a drum 200 which is driven in a rotary motion by a motor or similar drive source, not shown. The drum 200 is made up of a hollow metallic cylinder having a number of apertures, and a mesh screen covering the outer periphery of the hollow cylinder. Ink oozes out through the meshes of the mesh screen and the apertures of the hollow cylinder. A clamp 204 is provided on the drum 200 outside of a printing area in order to retain a stencil 202 having perforations representative of an image. The stencil 202 is caused to wrap around the drum 200 with the leading edge thereof retained by the clamp 204. An ink supply mechanism is disposed in the drum 200 and includes an ink supply tube 206 having ink outlets formed through part thereof. An inking roller 208 is held in contact with the inner periphery of the drum 200 and rotated by the drum 200. A rotatable doctor roller 210 is spaced apart from the inking roller 208 by a small gap. A generally V-shaped ink well is formed between the inking roller 208 and the doctor roller 210. In this configuration, ink kneaded in the V-shaped ink well is brought to the inner periphery of the drum 200 along the periphery of the inking roller 208.

Figure 7:
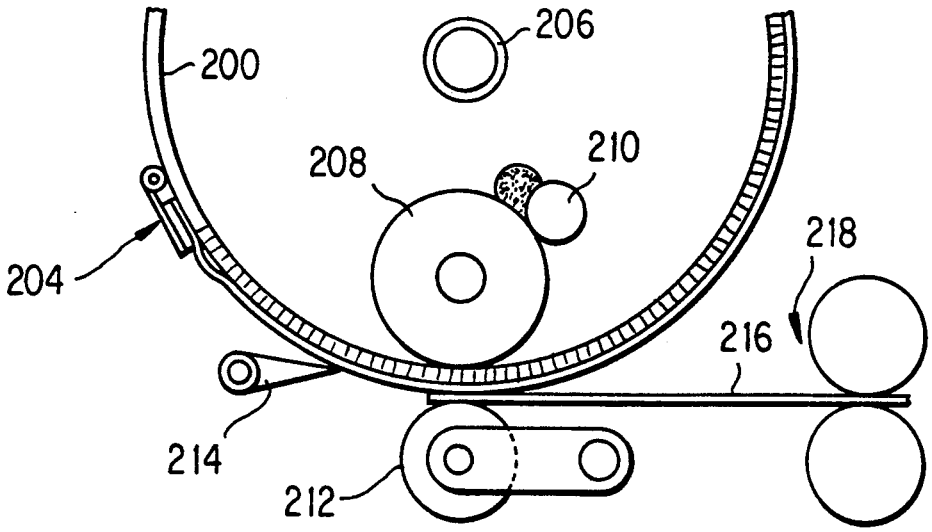

A press roller 212 is located to face the inking roller 208 with the intermediary of the wall of the drum 200. The press roller 212 is movable into and out of contact with the outer periphery of the drum 200. A separating pawl 214 is located downstream of the press roller 212 with respect to the direction of rotation of the drum 200 and movable into and out of contact with the drum 200. Specifically, the press roller 212 is moved toward the drum 200 while the transport of a sheet is under way, as will be described. The separating pawl 214 is moved toward the drum 200 at the instant when a printing procedure is completed. Otherwise, the roller 212 and pawl 214 each is spaced apart from the drum 200, as indicated by a dash-and-dots line in FIG. 6. As shown in FIG. 7, as a sheet 216 is fed from a register roller pair 218, the press roller 212 is shifted to a position where it presses the sheet 216 against the drum 200. The separating pawl 214 is brought to a position capable of separating the sheet 216 which has undergone a printing procedure at the position between the drum 200 and the press roller 212. A sheet feed device, not shown, is situated in the vicinity of the drum 200 and includes the register roller pair 218 which neighbors the position where the drum 200 and press roller 212 face each other. The register roller pair 218 drives the sheet 202 at a particular timing which allows the sheet 202 to meet the image of the stencil 216 loaded on the drum 200.

FIG. 8 shows a specific mechanism for urging the press roller 212 against the drum 200. As shown, the mechanism has an arm 222 which is rotatable about a shaft 220. The press roller 212 is supported by one end of the arm 222 while a cam follower 224 is rotatably mounted on the other end of the arm 222. An auxiliary arm 226 is positioned in close proximity to the center of rotation of the arm 222 and extends in a direction perpendicular to the direction connecting the opposite ends of the arm 222. A spring 228 is anchored at one end to the auxiliary arm 226 and at the other end to a stationary member, not shown. The spring 228 constantly biases the arm 226, i.e., the arm 222 in such a direction that the cam follower 224 is pressed against a cam 230. As shown in FIG. 9, the cam 230 has a unique profile which causes the press roller 212 to start contacting the drum 200 far earlier than the arrival of a perforation start point $\alpha$ corresponding to the leading edge of an image on the sheet 216, i.e., a position where the supply of ink begins. Specifically, in the illustrative embodiment, the cam profile is selected such that the press roller 212 begins to contact the drum 200 at a time when the perforation start point $\alpha$ is about 25 millimeters short of the position where the drum 200 and press roller 212 face each other. Therefore, the press roller 212 will have contacted the drum 200 when the sheet 216 arrives thereat.

In the above configuration, the press roller 212 begins to contact the drum 200 before the supply of a sheet 216. Hence, although the press roller 212 springs back or oscillates on hitting against the drum 200, the oscillation terminates before the start of a printing procedure, as indicated by a locus C in FIG. 9. More specifically, the influence of the oscillation and bounce caused when the press roller 212 hits against the drum 200 disappears before the start of a printing operation, so that the resultant image is free from the local omission of an image or an irregular density distribution.

The illustrative embodiment selects the profile of the cam 230 by taking account of the cam lift also. Specifically, as shown in FIG. 8, the cam lift causing the press roller 212 into contact with the drum 200 is set up later in the embodiment (indicated by a position $\theta_2$) than in a conventional printer (indicated by a position $\theta_1$). It follows that the embodiment causes the cam lift to change slowly and thereby slows down the movement of the press roller 212 toward the drum 200. This reduces the impact to be exerted by the press roller 212 on the drum 200 and, therefore, noise.

The press roller 212 may be implemented by a conductive substance having low resistance in place of the conventional nitrile rubber. Then, when the press roller 212 contacts the stencil 202 before the sheet 216 contacts the stencil 202, for example, the roller 212 dissipates a charge deposited on the stencil 202 to thereby prevent the sheet 216 from failing to separate from the stencil 202 due to the charge.

As stated above, this embodiment causes a press roller to start contacting a drum far earlier than the arrival of the leading edge of the image forming area of a sheet at the press roller. This is successful in urging the press roller against the sheet after the oscillation or bounce of the press roller has terminated. Consequently, the drum and an inking roller contact each other stably despite the oscillation or bounce, and a printing is free from the local omission of an image. Further, since the profile of a cam is so selected as to delay the time for setting up a cam lift which causes the press roller against the drum is to be set up, the moving speed of the press roller is reduced with the result that the impact and, therefore, noise is reduced when the press roller hits against the drum. In addition, when the press roller is made of a conductive substance, it is capable of dissipating a charge having been deposited on a stencil before a sheet contacts the stencil. Therefore, such a press roller prevents the sheet from electrostatically adhering to the stencil, i.e., allows the former from being surely separated from the latter.

Third Embodiment

This embodiment is directed toward the previously stated third object of the present invention, i.e., preventing ink intervening between the hollow cylindrical support of the drum and the stencil from leaking to the outside.

Figure 10:
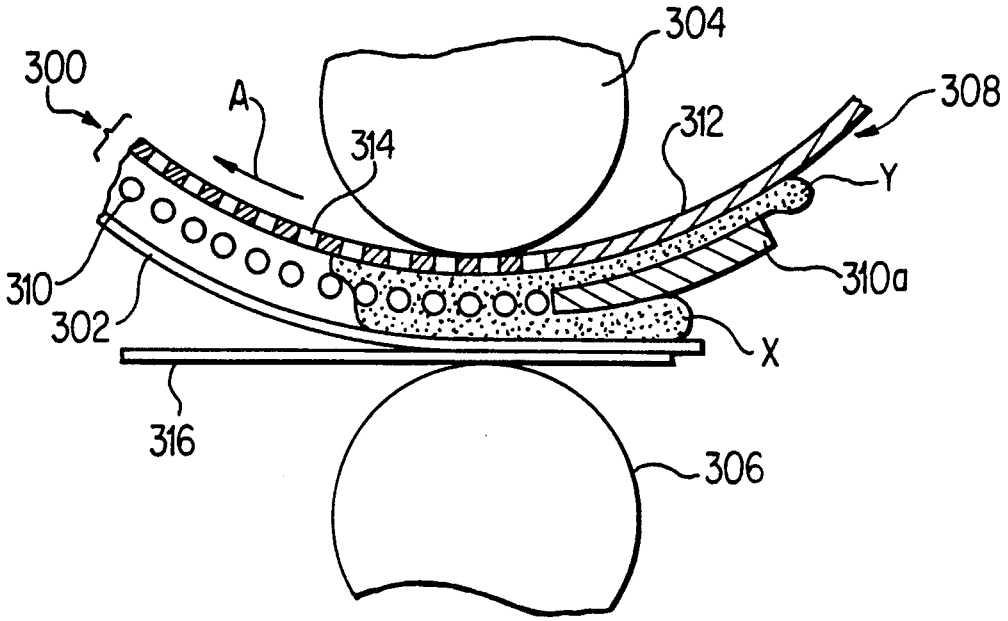
FIG. 10 PRIOR ART
FIGS. 10 and 11 are fragmentary views for explaining other problems particular to a conventional printer.

To better understand this alternative embodiment, a brief reference will be made to a conventional printer of the type using a stencil, shown in FIG. 10. As shown, the conventional printer has a rotatable hollow drum 300 loaded with a stencil 302, an ink supply device 304 disposed in the drum 300, and a press roller 306 facing the outer periphery of the drum 300. The drum 300 is made up of a hollow cylindrical support 308 and a screen layer 310. The support 308 has a non-permeable zone 312 not permeable to ink and a permeable zone 314 permeable to the same. The support 308 is implemented by a thin sheet of stainless steel or similar metal and formed with a number of apertures. A perforated stencil 302 having the leading edge thereof retained by a clamper, not shown, is wrapped around the screen layer 310 due to the viscosity of ink. While the drum 300 is rotated in a direction indicated by an arrow A in the figure, a sheet 316 is transported while being pressed aganist the drum 300 by the press roller 306. At the same time, ink passes through the perforations of the stencil 302 and is transferred to the surface of the sheet 316 to form an image thereon. As such a printing operation is repeated over a long period of time, the ink intervening between the stencil 302 and the cylindrical support 308 is sequentially forced to the rear by the press roller 306 until it bulges out from between the trailing edge of the stencil 302 and the rear portion 310*a* of the screen layer 310, as indicated by X in the figure. This part of the ink X smears not only the surface of the drum 300 but also the rear portion of the sheet 316 and smears even the back of the sheet 316 via the press roller 306. Further, the ink shifted to the rear by the press roller 306 reaches the interstice between the cylindrical support 308 and the screen layer 310. This part of the ink is simply forced to the rear along the interstice to bulge out from the trailing edge of the rear portion 310*a* of the screen layer 310, as indicated by Y in the figure, smearing the drum 300 and sheet 316. These problems are more pronounced when use is made of soft and highly infiltrative ink.

Figure 11:
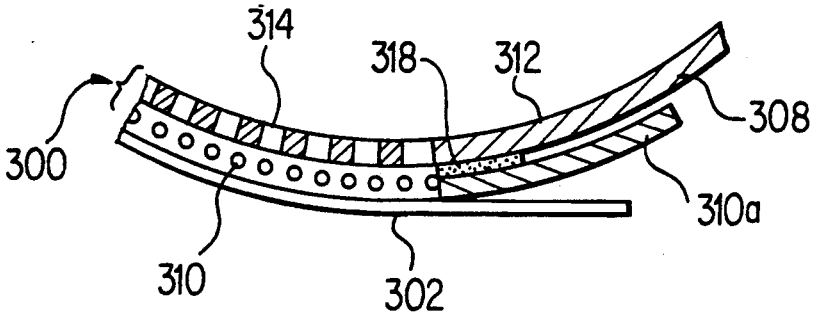
FIG. 11 PRIOR ART

While an implementation for eliminating the above problems is disclosed in, for example, Japanese Patent Publication No. 28670/1985, it cannot effectively cope with the above-mentioned leakage X of ink although successfully eliminating the leakage Y. As shown in FIG. 11, if the rear portion 310*a* of the screen layer 310 is connected to the cylindrical support 308 by adhesive 318, the leakage Y will be prevented. This, however, brings about another drawback, as follows. Generally, the screen layer 310 stretches little by little as the printing operation is repeated. It has been customary, therefore, to fasten the leading edge of the screen layer 310 to the support 308 by screws or similar fastening means and pull the rear end of the same to the rear by a spring or similar biasing means, thereby affixing the screen layer 310 to the support 308. It follows that adhering the rear portion 310*a* of the screen layer 310 as mentioned above prevents the stretch of the screen layer 310 from being absorbed, resulting in creases.

Figure 12:
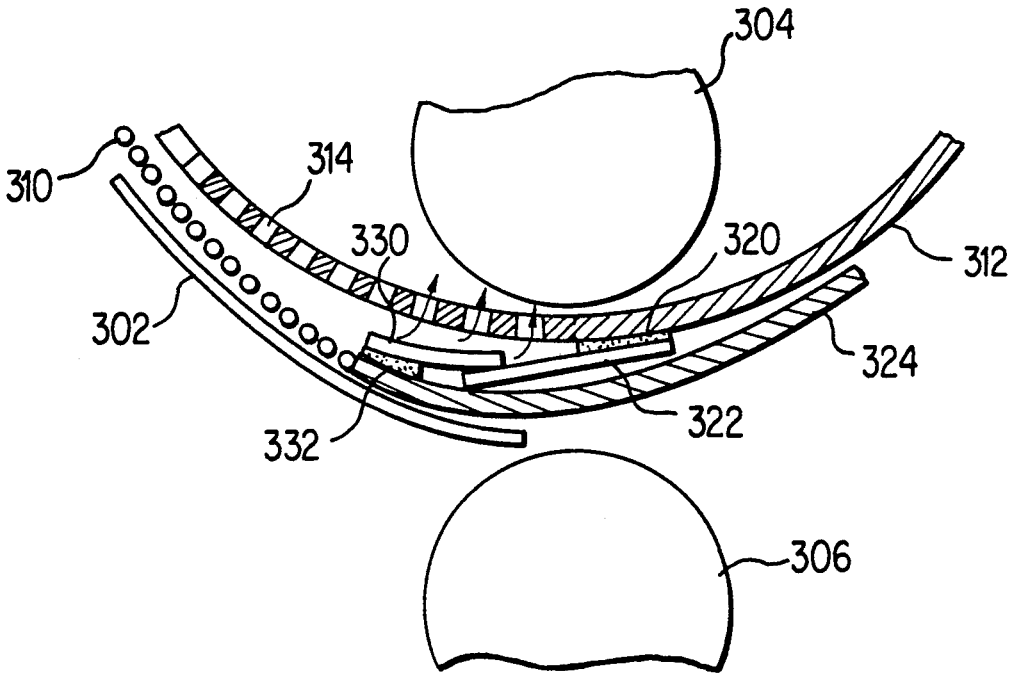
FIGS. 12 through 14 are views showing a third embodiment of the present invention.
Figure 13:
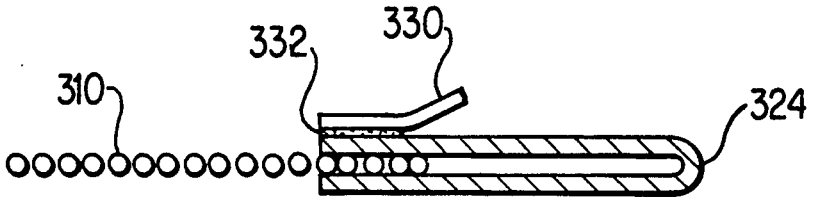
Figure 14:
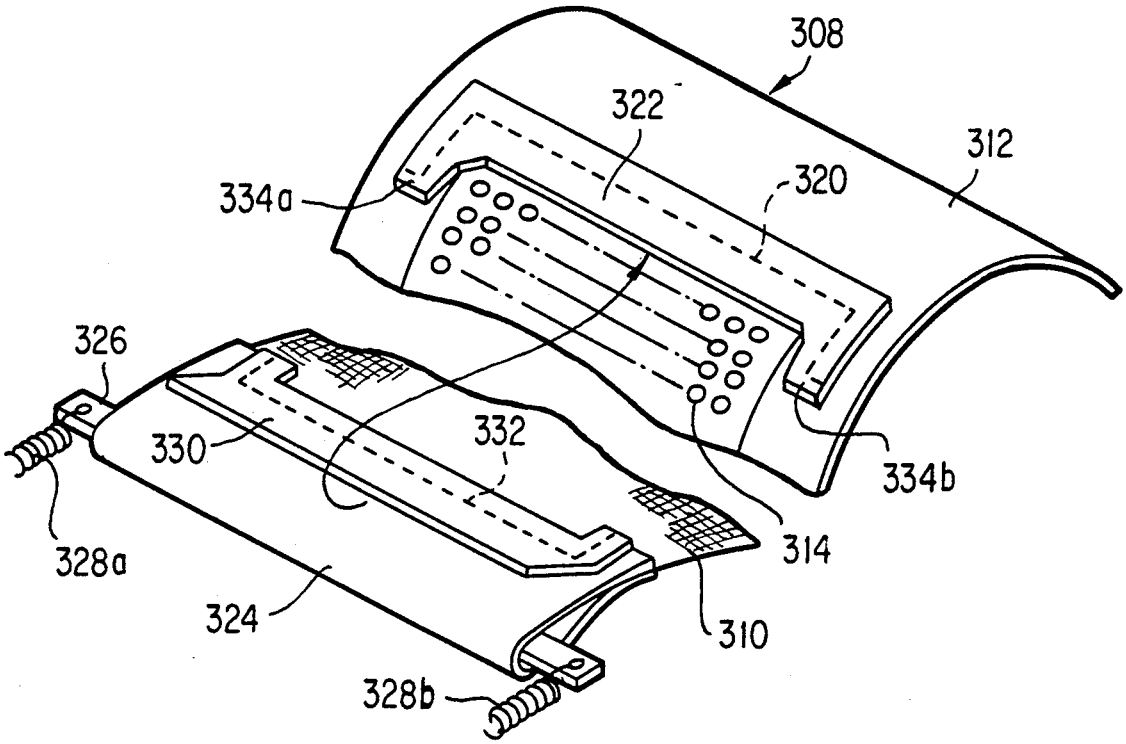

Referring to FIGS. 12–14, a third embodiment of the present invention which is free from the above problems will be described. In the figures, the same components as the components of the above-discussed conventional arrangement are designated by the same reference numerals, and redundant description will be avoided for simplicity.

As shown in FIG. 12, a thin and non-permeable first guide plate 322 is affixed to the outer periphery of the leading edge of a non-permeable zone 312 of a hollow cylindrical support 308 and extends toward a permeable zone 314. In practice, a screen layer 310 shown in FIG. 12 is implemented as a laminate of a few layers. As shown in FIG. 13, the rear portion of the screen layer 310 is retained by a member 324 made of vinyl leather or similar non-permeable material. A bar 326 is passed through the non-permeable member, or screen leather 324, and connected to the support 308 by springs 328*a* and 328*b*. The springs 328*a* and 328*b* constantly bias the screen layer 310, so that no gap exists between the screen layer 310 and the support 308. A second guide plate 330 is constituted by a thin flexible film and connected to the inner periphery of the leading edge of the screen leather 324 by adhesive 332. As shown in FIG. 14, the end of the second guide plate 330 is bent toward the support 308 and put under the end of the first guide plate 322. The guide plates 322 and 330 each is made of polyester or similar non-permeable substance and implemented as a 0.1 millimeter to 0.2 millimeter thick film. Each of the adhesive 320 and 332 should preferably be constituted by a two-sided adhesive tape whose adhesive power is immune to ink.

While the printer of the embodiment is in operation, the press roller 306 sequentially forces the ink between the support 308 and the stencil 302 to the rear. As a result, the ink tends to enter the interstice between the support 308 and the screen leather 324 and the interstice between the screen leather 324 and the trailing edge of the stencil 302. However, the ink between the support 308 and the screen leather 324 is guided by the second guide 330 and then by the first guide 322 to return to the inside of the support 308 via the apertures adjacent to the trailing end of the permeable zone 314. This part of the ink is, therefore, prevented from being further forced to the rear, so that the leakage from between the screen leather 324 and the stencil 302 is reduced. Although the pressure being exerted by the press roller 306 is about to be cancelled when the second guide plate 330 arrives thereat, it is still effective. Therefore, such a pressure forces the excessive ink into the inside of the support 308 via the apertures of the latter. As shown in FIG. 14, the first guide plate 322 should preferably have extensions 334*a* and 334*b* at opposite ends thereof with respect to the axial direction of the support 308, the extensions 334*a* and 334*b* each extending toward the permeable zone 314. Such opposite ends of the guide plate 322 are also adhered to the support 308. This is successful in preventing the ink from bulging out to both sides as well as to the rear.

As state above, in this embodiment, a thin and non-permeable first guide plate is adhered to the outer periphery of the leading edge of the non-permeable zone of a cylindrical support and extends toward a permeable zone. A thin and non-permeable second guide plate is provided on the inner periphery of a screen layer in a position where the second guide plate faces the first guide plate. The leading edge of the second guide plate extends toward the rear portion of the screen layer. Even when the printing operation is continued over a long period of time or when use is made of soft and highly infiltrative ink, the ink is prevented from leaking from between the support and the rear portion of the screen layer and, therefore, from smearing the printer body and sheets. In addition, the wasteful consumption of ink is eliminated. Moreover, since the screen layer is not affixed to the support, it is easy to replace and, even when stretched during operation, free from creases.

Fourth Embodiment

This embodiment is directed toward the previously stated fourth object of the present invention, i.e., preventing part of the ink from leaking at the sides of a drum.

Figure 15:
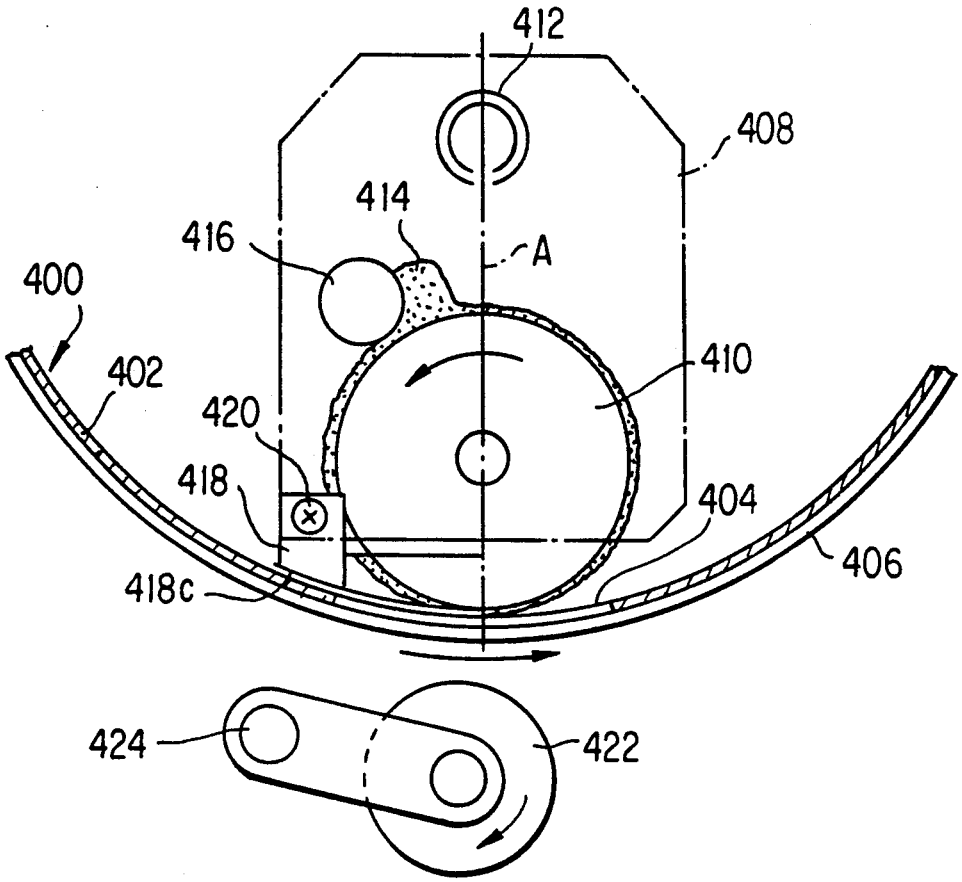
FIGS. 15 through 17 are views showing a fourth embodiment of the present invention.

As shown in FIG. 15, the fourth embodiment has a hollow cylindrical drum 400 having a predetermined width. The drum 400 is made up of an apertured portion 402 having a number of apertures for passing ink therethrough, and a non-apertured portion 404. A perforated stencil 406 is wrapped around the drum 400. The drum 400 is rotated counterclockwise, as viewed in the figure, by a motor, not shown. An inking roller 410 is disposed in the drum 400 and journalled to a side plate 408. The inking roller 410 has an axial dimension slightly smaller than that of the drum 400 and is slightly spaced apart from the inner periphery of the drum 400. A drive section, not shown, causes the inking roller 410 to rotate in the same direction as the drum 400. An ink supply tube 412 is disposed above the inking roller 410 and has substantially the same length as the inking roller 410 in the axial direction. A slit is formed through the bottom of the tube 412 for supplying ink 414 to the inking roller 410. A doctor roller 416 is supported by the side plate 408 and implemented as a rod. The doctor roller 416 is disposed below the ink supply tube 412 and at the ink ingress side of the inking roller 410, i.e., at the left-hand side of a dash-and-dot line A shown in FIG. 15 and in close proximity to the inking roller 410. The doctor roller 416 is spaced apart from the inking roller 410 by a small gap. The doctor roller 416 serves two different functions at the same time, i.e., a function of depositing the ink 414 fed from the tube 412 on the periphery of the inking roller 410, and a function of forming a layer of ink 414 having a uniform thickness on the inking roller 410.

Figure 16:
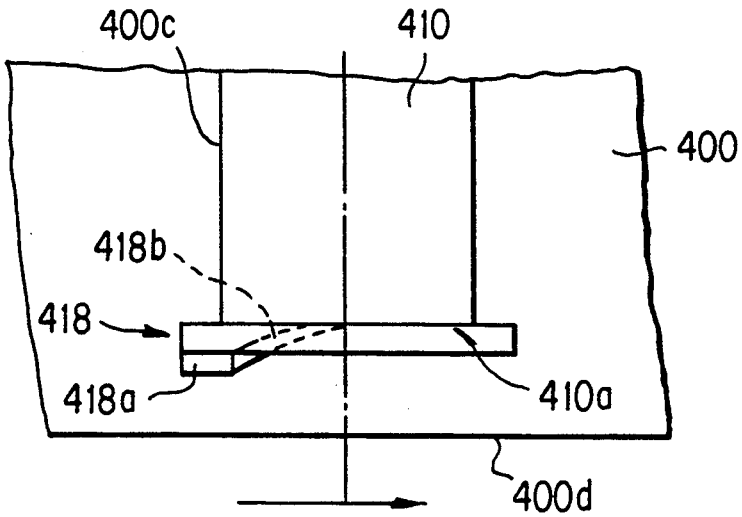

A scraper 418 is fastened to the lower portion of the side plate 408 by a screw 420 at the ingress side of the inking roller 410 and spaced apart from the inner periphery of the drum 400 by a small gap. As shown in FIG. 16, as the ink 414 drops onto the part of the inner periphery 400*c* of the drum 400 which is located at the side and below the inking roller 410 due to the rotation of the inking roller 410, the scraper 418 restricts the leakage of this part of the ink 414 from the end 410*a* of the roller 410 to the edge 400*d* of the drum 400. More specifically, one end 418*a* of the scraper 418 protrudes to the left, as viewed in the figure, such that it stops the outside of the outer periphery of the inking roller 410, i.e., the portion of the inner periphery 400*c* adjacent to the end 410*a*. The inner surface 418*b* of the other end of the scraper 418 is held in contact with the end 410*a*. The scraper 418 is bent inwardly in the form of a letter V in the direction of rotation of the drum 400 from the position where it is affixed to the side wall 408 to the position where it adjoins the end 410*a* of the inking roller 410. The bottom 418*c* of the scraper 418 is provided with an arcuate configuration having substantially the same curvature as the inner periphery of the drum 400.

A press roller 422 is rotatably mounted on a shaft 424 and located to face the inking roller 410 with the intermediary of the drum 400. The press roller 422 is spaced apart from the drum 400 and held in engagement with a sheet sensing member, not shown, except for a printing period, i.e., when the non-apertured portion 404 of the drum 400 is positioned between the inking roller 410 and the press roller 422. During a printing period, i.e., when the apertured zone 402 of the drum 400 is positioned between the rollers 410 and 422, the press roller 422 is released from the sheet sensing member and pressed against the apertured zone 402.

Figure 17:
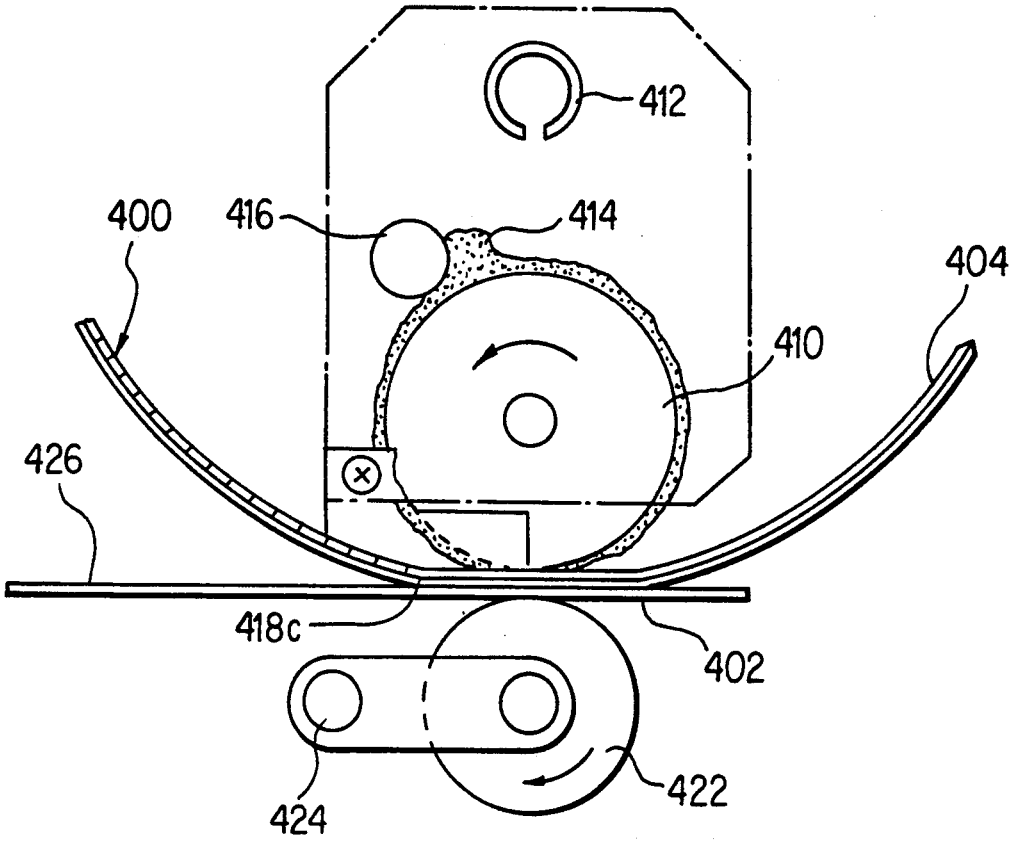

In response to a print command, the drum 400 and inking roller 410 are rotated. Then, the uniform ink layer 414 formed on the inking roller 410 is caused to fly and deposit in the vicinity of the inner periphery 400*c* of the drum 400. At the same time, a sheet 426, FIG. 17, is fed at a predetermined timing from a sheet feed device, not shown, to between the outer periphery of the drum 400 and that of the press roller 422, i.e., a contact region. At this instant, the press roller 422 is released from the sheet sensing member and pressed against the apertured zone 402 of the drum 400. As a result, the inner periphery of the drum 400 is pressed against the outer periphery of the inking roller 410. In this condition, the ink 414 oozes from the drum 400 to print out an image on the sheet 426. When the drum 400 completes one rotation to position the non-apertured zone 404 between the outer periphery thereof and that of the press roller 422, the press roller 422 is restored to the standby state. This is the end of the printing operation performed with the first sheet 426. Such a procedure is repeated until a print stop command arrives. As the press roller 422 is pressed against the outer periphery of the drum 400, the bottom 418*c* of the scraper 418 presses itself against the inner periphery 400*c* of the drum 400 to the portion where it adjoins the end of the inking roller 410. In this position, the scraper 418 prevents the ink 414 having deposited on the inner periphery 400*c* from flowing out via the end of the inking roller 410. On the return of the press roller 422 to the standby position, the bottom 418*c* of the scraper 418 is released from the inner periphery of drum 400. In this manner, the scraper 418 does not contact the inner periphery of the drum 400 except for the pressing range of the press roller 422, i.e., the range of the apertured portion 402 of the drum 400. This reduces the wear of the scraper 418, compared to a scraper of the type constantly held in contact with the drum 400.

Figure 18:
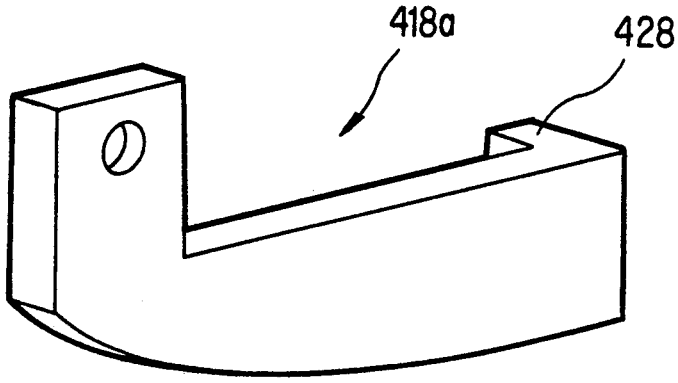
FIG. 18 is a perspective view showing a modified form of a scraper included in the fourth embodiment.

FIG. 18 shows a modified form of the scraper 418. As shown, the modified scraper 418A is implemented as a flat plate parallel to the end 410*a* of the inking roller 410. One end 428 of the scraper 418A is bent substantially at a right angle. The scraper 418A, like the scraper 418, is mounted on the side plate 408 in such a manner as to contact the end 410*a* of the inking roller 410 and the inner periphery of the drum 400.

As stated above, this embodiment has a scraper which closes the end of an inking roller and that of a drum to prevent ink from leaking at the end of the inking roller. This is successful in eliminating the leakage of the ink at the end of the drum and the scattering of ink in masses and, therefore, in freeing the interior of a printer from smears and printings from irregularities. In addition, the ink is effectively consumed since it is preventing from leaking.

Various modifications will become possible for those skilled in the art after receiving the teachings of the present disclosure without departing from the scope thereof.

What is claimed is:

1. A printer for printing out an image formed in a stencil on a sheet, comprising:

a rotatable drum comprising a hollow cylindrical support constituted by a permeable zone which is formed with a number of apertures and a non-permeable zone;

mesh screen means covering an outer periphery of said support, a stencil being wrapped around an outer periphery of said screen means;

clamp means provided on said non-permeable zone of said support for clamping one edge of said stencil wrapped around said screen means;

ink supply roller means disposed in said support for supplying ink to said stencil via said permeable zone of said support;

press roller means for pressing a sheet against said stencil;

a thin non-permeable first guide plate adhered by a first adhesive to an outside of a leading edge of the non-permeable zone with a tip thereof directed toward the permeable zone; and a thin non-permeable second guide plate adhered by a second adhesive to said screen means at an inside of said screen means at a position such that a tip of said second guide plate is adjacent a trailing portion of said screen means, a portion of said second guide plate being located closer to said support than a portion of said first guide plate.

2. A printer as claimed in claim 1, wherein each of said first and second guide plates is made of polyester.

3. A printer as claimed in claim 1, wherein each of said first and second adhesives is constituted by a two-sided adhesive tape.

* * * * *

UNITED STATES PATENT AND TRADEMARK OFFICE

CERTIFICATE OF CORRECTION

PATENT NO. : 5,255,599

DATED : October 26, 1993

INVENTOR(S) : Kazuyosi Kobayasi et al.

It is certified that error appears in the above-indentified patent and that said Letters Patent is hereby corrected as shown below:

On the title page, Item [75],

The third inventor's name, should read: --Mitsuo Satō--

Signed and Sealed this

Nineteenth Day of April, 1994

Bruce Lehman

*Attest:*

BRUCE LEHMAN

*Attesting Officer*

*Commissioner of Patents and Trademarks*